US008445056B2

(12) United States Patent
Liu et al.

(10) Patent No.: US 8,445,056 B2
(45) Date of Patent: May 21, 2013

(54) METHOD FOR MANUFACTURING FIELD EMISSION CATHODE

(75) Inventors: Chang-Hong Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 246 days.

(21) Appl. No.: 12/975,518

(22) Filed: Dec. 22, 2010

(65) Prior Publication Data

US 2011/0088829 A1 Apr. 21, 2011

Related U.S. Application Data

(63) Continuation-in-part of application No. 11/779,244, filed on Jul. 17, 2007, now Pat. No. 8,247,024.

(30) Foreign Application Priority Data

Jul. 19, 2006 (CN) ..... 2006 1 0061705

(51) Int. Cl.
*B05D 5/12* (2006.01)
*B05D 5/06* (2006.01)
*B05D 3/12* (2006.01)

(52) U.S. Cl.
USPC ..... 427/64; 427/240

(58) Field of Classification Search
USPC ..... 427/64
See application file for complete search history.

*Primary Examiner* — James Lin
*Assistant Examiner* — Austin Murata
(74) *Attorney, Agent, or Firm* — Altis Law Group, Inc.

(57) ABSTRACT

A method for manufacturing a field emission cathode is provided. A carbon nanotube array formed on a substrate in a container and a prepolymer are provided. The prepolymer is put into the container settled for a period of over 30 minutes to fill in clearances of the carbon nanotube array, and part of the prepolymer is covering a top end of the carbon nanotube array. The carbon nanotube array is rotated at a speed to push the part of the prepolymer into the clearances of the carbon nanotube array and a prepolymer film in the carbon nanotube array is obtained. The prepolymer film is then polymerized to form a polymer film.

18 Claims, 3 Drawing Sheets

METHOD FOR MANUFACTURING FIELD EMISSION CATHODE

RELATED APPLICATIONS

This application is a continuation-in-part application of U.S. patent application Ser. No. 11/779,244, filed Jul. 17, 2007 entitled, "METHOD FOR MANUFACTURING FIELD EMISSION CATHODE."

BACKGROUND

1. Technical Field

The invention relates to methods for manufacturing field emission cathodes and, particularly, to a method for manufacturing a field emission cathode including a carbon nanotube array.

2. Description of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). Carbon nanotubes are electrically conductive along their length, are chemically stable, and can have, individually, very small diameters (much less than 100 nanometers) and large aspect ratios (length/diameter). Due to these and other properties, it has been suggested that carbon nanotubes can play an important role in fields such as microscopic electronics, field emission devices, thermal interface materials, etc.

Generally, a CNT field emission device includes a field emission cathode. The field emission cathode includes a conductive electrode and a carbon nanotube array formed on the conductive electrode. The method for manufacturing the field emission cathode mainly includes the following steps: firstly, providing a silicon or silicon dioxide substrate; secondly, forming a conductive electrode on the substrate; thirdly, forming a catalyst layer on the conductive electrode; fourthly, heating the substrate with the catalyst layer formed thereon in air at a temperature in the approximate range from 300° C. to 500° C. for 10 minutes to 12 hours, then annealing the substrate to obtaining catalyst particles; fifthly, placing the substrate with the catalyst particles disposed thereon in a reaction device, introducing a protection gas thereinto, and heating the substrate to a temperature in the approximate range from 400° C. to 750° C.; and introducing a reaction gas into the reaction device for 0.5 minutes to 2 hours to grow a carbon nanotube array on the substrate.

As the field emission cathode is used, an insulative layer can beneficially be adopted/incorporated among adjacent carbon nanotubes to avoid the electromagnetic shielding among the carbon nanotubes. However, the typical method for manufacturing the insulative layer is relatively complex and thus, is not fit for mass production. Furthermore, the toughness and pliability of the field emission cathode is relatively poor and is generally not fit for flexible display devices.

What is needed therefore, is a method for manufacturing a field emission cathode which includes an electrode and an insulating film incorporated therewith. What is further needed is a field emission cathode that is fit for flexible display devices. Furthermore, what is needed is a method for producing such that is relatively easy and that can be used in mass production.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Reference will now be made to the drawings to describe embodiments of the present method for manufacturing a field emission cathode, in detail.

Figure 1:
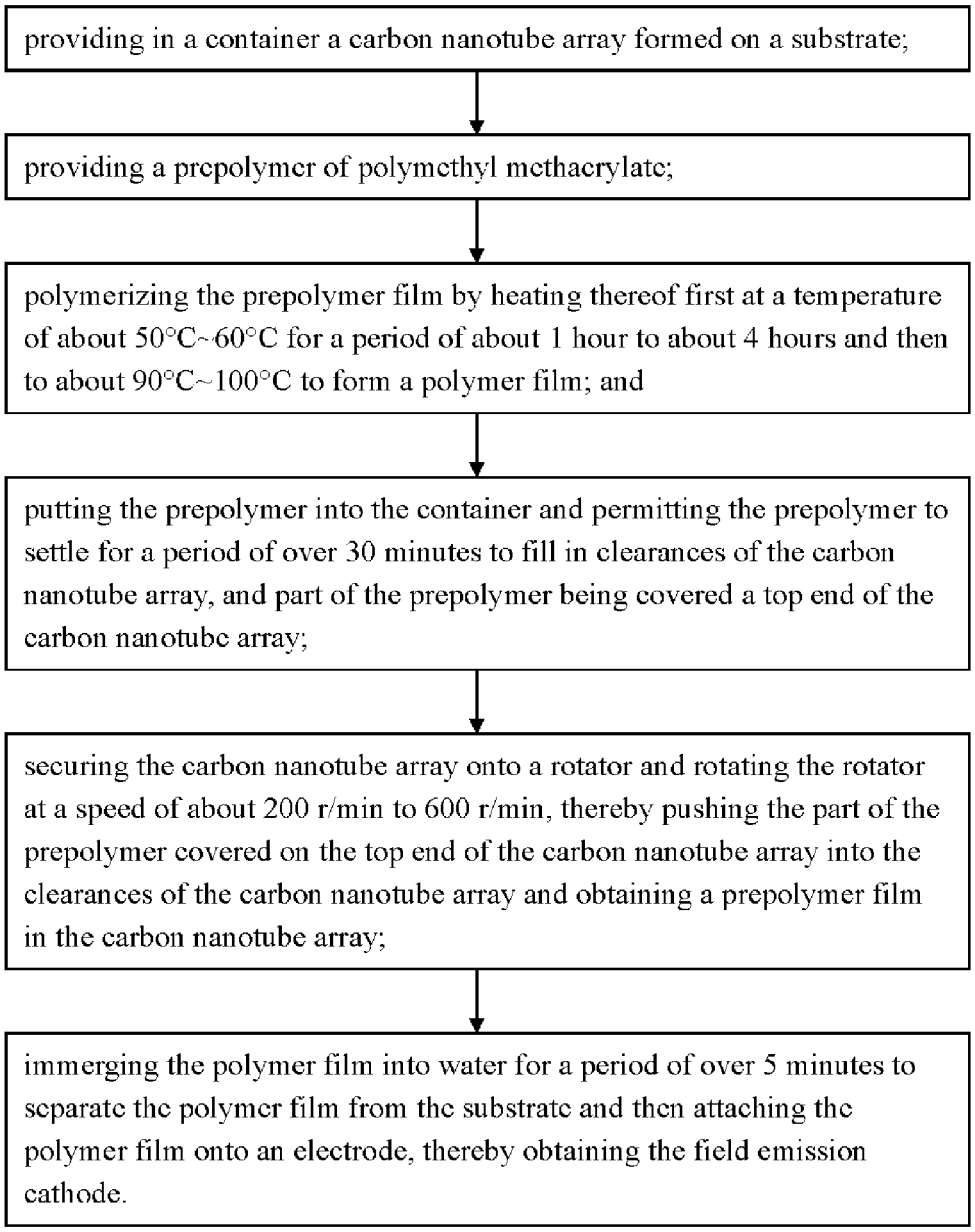
FIG. 1 is a flow chart of the present method for manufacturing a field emission cathode.

Referring to FIG. 1, a method for manufacturing a field emission cathode includes the following steps: (a) providing a carbon nanotube array formed on a substrate in a container; (b) providing a prepolymer of polymethyl methacrylate (PMMA); (c) putting the prepolymer into the container and permitting the prepolymer to settle for a period of over 30 minutes to fill in clearances of the carbon nanotube array, and part of the prepolymer is covered a top end of the carbon nanotube array; (d) securing the carbon nanotube array onto a rotator and rotating the rotator at a speed of about 200 r/min to 600 r/min, thereby pushing the part of the prepolymer covered on a top end of the carbon nanotube array into the clearances of the carbon nanotube array and thus, obtaining a prepolymer film in the carbon nanotube array; (e) polymerizing by first holding the prepolymer film at a temperature of about 50° C. to 60° C. for a period of about 1 hour to 4 hours and then heating the prepolymer film to about 90° C. to 100° C. to form a polymer film; and (f) immerging the polymer film into water for a period of over 5 minutes to separate the polymer film from the substrate and then attaching the polymer film onto an electrode, thereby obtaining the field emission cathode. It is, however, to be understood that depending on the prepolymer material employed, the curing thereof to form the polymer film could be achieved, e.g., by another heating protocol and/or by application of ultraviolet radiation thereto.

In step (a), the carbon nanotube array is manufactured by means of chemical vapor deposition (CVD), and a height thereof is advantageously in the approximate range from 10 micrometers to 1000 micrometers. The carbon nanotube array includes a top end and a bottom end opposite with the top end. The bottom end of the carbon nanotube array is formed on the substrate.

Step (a) comprises the steps of:

(a1) providing a substrate;

(a2) forming a catalyst layer on the substrate;

(a3) heating the substrate with the catalyst layer formed thereon and annealing the substrate to obtaining catalyst particles;

(a4) placing the substrate with the catalyst particles disposed thereon in a reaction device, introducing a protection gas thereinto, and heating the substrate to a predetermined temperature; and (a5) introducing a reaction gas into the reaction device to grow the carbon nanotube array on the substrate.

In step (a1), the substrate can be made of glass, quartz, silicon, or alumina.

In step (a2), the catalyst layer can be disposed on the substrate by chemical vapor deposition, thermal disposition, electron-beam disposition, or sputtering. The catalyst layer can be iron (Fe), cobalt (Co), nickel (Ni), or an alloy thereof. A thickness of the catalyst layer is determined by the material of the catalyst layer. In one useful embodiment, the catalyst layer is made of iron (Fe), and the thickness thereof is in the approximate range from about 3 nanometers to about 10 nanometers. Quite usefully, the thickness of the iron catalyst layer is about 5 nanometers.

In step (a3), the substrate with the iron catalyst layer formed thereon is heated in air at a temperature in the approximate range from 300° C. to 500° C. for about 10 minutes to 12 hours. After the process of annealing, ferric oxide particles are formed on the substrate.

In step (a4), the predetermined temperature is chosen according to the material of the catalyst layer and is beneficially in the approximate range from 400° C. to 750° C. If using iron as the catalyst material, the predetermined temperature is opportunely about 650° C. Furthermore, the protection gas can be an inert gas and/or nitrogen gas. Advantageously, the protection gas is argon gas. In step (a5), the reaction gas is a carbon source gas and is introduced into the reaction device for 0.5 minutes to 2 hours. One appropriate carbon source gas is a hydrocarbon such as acetylene or ethene. Quite suitably, the carbon source gas is ethene.

Step (b) includes the steps of: (b1) mixing methyl methacrylate (MMA), azodiisobutyronitrile (AIBN) and dibutyl phthalate (DBP); (b2) milling the mixture formed in step (b1) for about 5 minutes to 30 minutes in a water bath of 80° C. to 100° C., thereby polymerizing the MMA; and (b3) cooling the mixture.

In step (b1), the MMA is used as a main body, and a mass percent thereof in the mixture is advantageously in the approximate range from 95% to 100%. Meanwhile, the AIBN is used as an initiator, and a mass percent thereof in the mixture is usefully in the approximate range from 0.02% to 1%. Lastly, the DBP is used as a plasticizer, and a mass percent thereof in the mixture is beneficially in the approximate range from 0% to 5%. In step (b2), the mixture is suitably milled for 10 minutes in the water bath at 92° C. The polymerized MMA has a working viscosity, so as to be readily placed on the substrate yet be able to generally hold its position until cured.

Before step (c), the air in the carbon nanotube array is removed in advance. The step of removing the air in the carbon nanotube array can be executed after step (a), and the step is executed by evacuating the container advantageously, to a vacuum level of at least about $5\times10^{-2}$ torr. Alternatively, the step of removing/evacuating the air in the carbon nanotube array can be provided after step (b). In step (c), the goal is to achieve sufficient settling of the prepolymer within the carbon nanotube array, such that each adjacent carbon nanotube pair has prepolymer material therebetween, at least along the length portion thereof to remain within the PMMA layer (e.g., to properly insulate and reinforce adjacent nanotubes). The clearances of the carbon nanotube array are very small, and the clearances are not full of the prepolymer. Part of the prepolymer is also covering the top end of the carbon nanotube array. Step (c) yields an initial prepolymer film within the carbon nanotube array, the final thickness of which is then determined by the parameters associated with step (d). It is to be further understood that the settling process of step (c) could be aided by the application of vibrations to the container and/or ultrasonic vibrations within the prepolymer carrier employed in such step.

Figure 2:
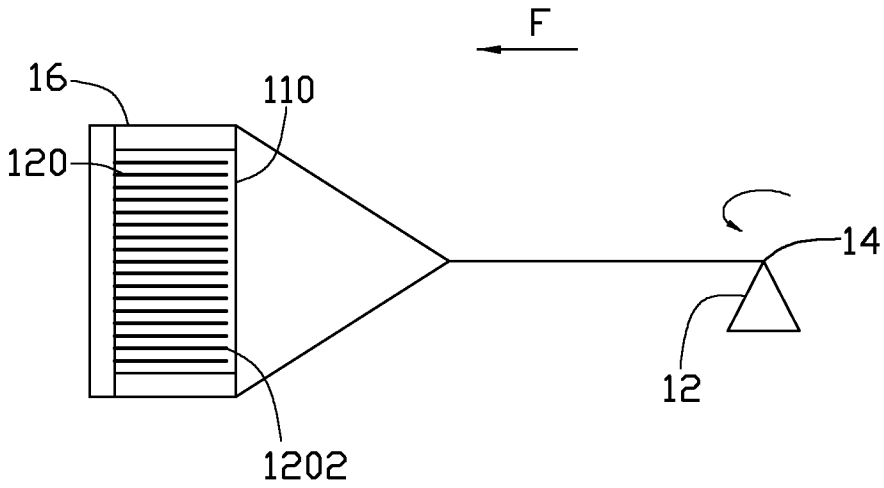
FIG. 2 is a schematic view of a carbon nanotube array with a prepolymer fixed on a rotator according to one embodiment.

Referring to FIG. 2, the carbon nanotube array 120 with the prepolymer 110 is fixed on a rotator 12 via the container 16. The upper end 1202 of the carbon nanotube array points towards the center 14 of rotator 12. The part of the prepolymer 110 is pushed into the clearances of the carbon nanotube array 120 by applying a centrifugal force F via the rotator 12, along with an axis direction of the carbon nanotubes in the carbon nanotube array 120. That is to say, the carbon nanotube array is rotated along an axis with the top end rotated with a first radius and the bottom end rotated with a second radius larger than the first radius. The centrifugal force pushes the part of the prepolymer covered on the top end of the carbon nanotube array into the clearances of the carbon nanotube array along a direction from the top end to the bottom end of the carbon nanotube array. During the process of pushing the part of the prepolymer 110, because the clearances of the carbon nanotube array are not full of the prepolymer 110, the part of the prepolymer 110 covering the upper end 1202 of the carbon nanotube array will get into clearances of the carbon nanotube array 120. Thus, the upper end of the carbon nanotube array extends from the prepolymer, with the prepolymer film thereby existing therewithin. In step (e), the polymer film is particularly a composite CNT-PMMA film.

Figure 3:
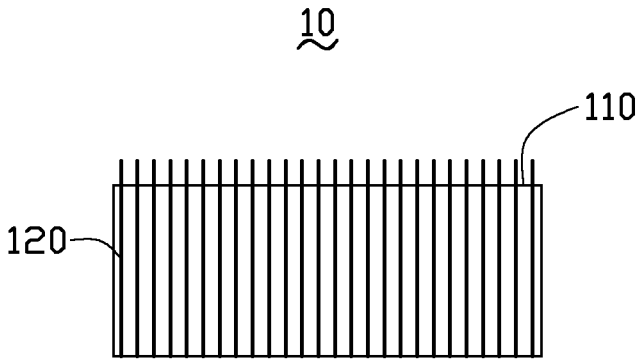
FIG. 3 is a longitudinal sectional view of a CNT-PMMA film of the field emission cathode manufactured by the method of FIG. 1.

Referring to FIG. 3, a CNT-PMMA film 10 of the field emission cathode manufactured by the present method is shown. A thickness of the CNT-PMMA film 10 is useful in the approximate range from 10 micrometers to 1000 micrometers and mainly includes a carbon nanotube array 120 and a polymer of PMMA 110 interspersed/incorporated within the carbon nanotube array 120. A top end of the carbon nanotube array 120 advantageously extends from a top surface of the polymer of PMMA 110 by about 10 nanometers to about 200 nanometers, especially when the carbon nanotubes act as field emitters. A bottom end of the carbon nanotube array 120 is substantially even with a bottom surface of the polymer of PMMA 110 and, thus, uncovered by the polymer of PMMA 110.

It is to be understood that when the upper end of the carbon nanotube array 120 need not be exposed (e.g., thermal conduction interface, mechanical composite usage, etc.), the polymer of PMMA 110 could be permitted to extend the length of the nanotubes (i.e., to the distal ends thereof) within the array (e.g., step (d) could be skipped). Such full-length extension would facilitate maximum support and protection by the polymer while still allowing an electrical and/or thermal connection to be made with a given distal end of the array. Thus, it is to be understood that the CNT-PMMA film 10 could be easily modified to fulfill other uses, than just for field emission devices. In light of the potential uses for the CNT-PMMA film 10, it is further understood that a temporary/removable substrate could be employed initially (e.g., as per step (e)) or the substrate could instead be chosen in conjunction with the ultimate desired use for the composite (i.e., to remain as part of the final structure).

Compared with the conventional field emission cathode, the field emission cathode manufactured by the present method includes an electrode and a CNT-PMMA polymer film attached on the electrode thereby having the following virtues. Firstly, the CNT-PMMA polymer film has relatively good toughness and pliability, allowing the CNT-PMMA polymer to be bent freely. Therefore, a field emission cathode adopting the CNT-PMMA polymer is fit for flexible display devices. Secondly, the top and bottom ends of the carbon nanotube array in the CNT-PMMA polymer film extend to or is even from the top and bottom surfaces of the polymer of PMMA respectively, and thus, the CNT-PMMA film has double-faced conductive performance. Thirdly, the air in the carbon nanotube array is removed in advance. As such, thus the polymer of PMMA sufficiently fills in the clearance of the carbon nanotube array. Therefore, electromagnetic shielding among the carbon nanotubes can be avoided. Therefore, the present method is relatively easy to carry out and can be used in mass production.

Finally, it is to be understood that the above-described embodiments are intended to illustrate rather than limit the present disclosure. Variations may be made to the embodiments without departing from the spirit of the present disclosure as claimed. The above-described embodiments illustrate the scope but do not restrict the scope of the present disclosure.

What claimed is:

1. A method for manufacturing a carbon nanotube/polymer composite, the method comprising the steps of:

(a) providing a carbon nanotube array comprising a plurality of carbon nanotubes and a plurality of clearances formed on a substrate;

(b) providing a prepolymer material;

(c) putting the carbon nanotube array in prepolymer material, permitting the prepolymer to settle for a period to fill in clearances of the carbon nanotube array, and part of the prepolymer covering on a top end of the carbon nanotube array;

(d) applying centrifugal force along with an axis direction of the carbon nanotubes in the carbon nanotube array, and pushing the part of the prepolymer covered on the top end of the carbon nanotube array into the clearances of the carbon nanotube array and obtaining a prepolymer film in the carbon nanotube array;

(e) polymerizing the prepolymer film to form a polymer film, the carbon nanotube array thereby being embedded within the polymer film.

2. The method of claim 1, wherein in step (d), the top end of the carbon nanotube array extends from a top surface of the prepolymer film.

3. The method of claim 1, wherein in step (d), the top end of the carbon nanotube array extends from the top surface of the prepolymer film for about 10 nanometers to about 200 nanometers.

4. The method of claim 1, wherein in step (a), the carbon nanotube array has a bottom end formed on the substrate; and in step (d), the centrifugal force pushes the part of the prepolymer covered on the top end of the carbon nanotube array into the clearances of the carbon nanotube array along a direction from the top end to the bottom end of the carbon nanotube array.

5. A method for manufacturing a carbon nanotube/polymer composite, the method comprising:

(a) providing a carbon nanotube array formed on a substrate in a container;

(b) providing a prepolymer material;

(c) putting the prepolymer into the container and permitting the prepolymer to settle for a period to fill in clearances of the carbon nanotube array, and part of the prepolymer covering a top end of the carbon nanotube array;

(d) securing the carbon nanotube array onto a rotator and rotating the rotator, pushing the part of the prepolymer covered on the top end of the carbon nanotube array into the clearances of the carbon nanotube array and obtaining a prepolymer film in the carbon nanotube array, wherein the top end of the carbon nanotube array points towards a center of rotator;

(d) polymerizing the prepolymer film to form a polymer film, the carbon nanotube array thereby being embedded within the polymer film.

6. The method of claim 5, wherein in the step (d), the rotator is rotated at a speed of about 200 r/min to about 600 r/min.

7. The method of claim 5, wherein in step (d), the part of the prepolymer covered on the top end of the carbon nanotube array is pushed into the clearances of the carbon nanotube array by applying a centrifugal force via the rotator along an axis direction of the carbon nanotubes in the carbon nanotube array.

8. The method of claim 5, wherein in step (d), the top end of the carbon nanotube array extends from a top surface of the prepolymer film.

9. The method of claim 8, wherein in step (d), the top end of the carbon nanotube array extends from the top surface of the prepolymer film for about 10 nanometers to about 200 nanometers.

10. A method for manufacturing a field emission cathode, the method comprising:

(a) providing a carbon nanotube array formed on a substrate in a container;

(b) providing a prepolymer of polymethyl methacrylate (PMMA);

(c) putting the prepolymer into the container and permitting the prepolymer to settle for a period of over 30 minutes to fill in clearances of the carbon nanotube array, and part of the prepolymer covering a top end of the carbon nanotube array;

(d) securing the carbon nanotube array onto a rotator and rotating the rotator at a speed of about 200 r/min to 600 r/min, thereby pushing the part of the prepolymer covered on the top end of the carbon nanotube array into the clearances of the carbon nanotube array and obtaining a prepolymer film in the carbon nanotube array, wherein the top end of the carbon nanotube array points towards the center of rotator;

(e) polymerizing the prepolymer film by heating at a temperature of about 50° C. to about 60° C. for a period of about 1 hour to about 4 hours and then to about 90° C. to about 100° C. to form a polymer film; and (f) immerging the polymer film into water for a period of over 5 minutes to separate the polymer film from the substrate and then attaching the polymer film onto an electrode, thereby obtaining the field emission cathode.

11. The method of claim 10, wherein step (b) comprises:

(b1) mixing methyl methacrylate (MMA), azodiisobutyronitrile (AIBN), and dibutyl phthalate (DBP), the MMA having a mass percent thereof in the mixture in an approximate range from 95% to 99.98%, the AIBN having a mass percent thereof in the mixture in the range from about 0.02% to about 1%, and the DBP having a mass percent thereof in the mixture in the range from about 0% to about 5%;

(b2) milling the mixture formed in step (b1) for about 5 minutes to about 30 minutes in a water bath at an approximate temperature of about 80° C. to about 100° C., thereby polymerizing the MMA; and (b3) cooling the mixture.

12. The method of claim 10, wherein in step (a), a height of the carbon nanotube array is in an approximate range from about 10 micrometers to about 1000 micrometers.

13. The method of claim 10, wherein a step of removing air in the carbon nanotube array is further provided after step (a), and is executed by evacuating the container.

14. The method of claim 10, wherein a step of removing air in the carbon nanotube array is further provided after step (b), and executed by evacuating the container.

15. The method of claim 10, wherein in step (c), vibrations are employed to aid settling of the prepolymer within the carbon nanotube array.

16. The method of claim 10, wherein in step (d), the part of the prepolymer covered on the top end of the carbon nanotube array is pushed into the clearances of the carbon nanotube array by applying a centrifugal force via the rotator along an axis direction of the carbon nanotubes in the carbon nanotube array.

17. The method of claim 1, wherein in step (d), the top end of the carbon nanotube array extends from a top surface of the prepolymer film.

18. The method of claim 17, wherein after step (d), the top end of the carbon nanotube array extends from the top surface of the prepolymer film by about 10 nanometers to about 200 nanometers.

* * * * *